US008737665B2

(12) United States Patent
Chung et al.

(10) Patent No.: US 8,737,665 B2
(45) Date of Patent: May 27, 2014

(54) NEGATIVE PRESSURE EARPHONE

(75) Inventors: Chu Ming Chung, Grand Cayman (KY); Lee Pin Tang, Grand Cayman (KY)

(73) Assignee: Eastern Technologies Holding Limited, Cayman Islands (KY)

( * ) Notice: Subject to any disclaimer, the term of this patent is extended or adjusted under 35 U.S.C. 154(b) by 117 days.

(21) Appl. No.: 13/435,068

(22) Filed: Mar. 30, 2012

(65) Prior Publication Data

US 2013/0259286 A1 Oct. 3, 2013

(51) Int. Cl.
*H04R 25/00* (2006.01)
*H04R 1/20* (2006.01)

(52) U.S. Cl.
USPC ..... 381/372; 381/354; 381/370; 381/371; 381/380

(58) Field of Classification Search
USPC ..... 381/353–354, 370–372, 380; 181/129–130
See application file for complete search history.

(56) References Cited

U.S. PATENT DOCUMENTS 4,005,278 A * 1/1977 Gorike ..... 381/373

* cited by examiner

*Primary Examiner* — Matthew Eason
(74) *Attorney, Agent, or Firm* — Chun-Ming Shih

(57) ABSTRACT

A negative pressure earphone includes a main body, a cover portion, a silicone gel earplug, a filtering net and a moving coil sound unit. The silicone gel earplug is fitted to the protruding end of the main body. The filtering net is provided on the opening of the protruding end and the moving coil sound unit is disposed inside the main body. The cover portion is fitted to the other end of the main body. A sealing framework portion is disposed inside the main body and the moving coil sound unit is fitted to the sealing framework portion. A negative pressure portion is disposed on the sealing framework portion. The negative pressure earphone of the present invention is structurally simple and water resistant and does not have to have an opening in its cover portion.

5 Claims, 6 Drawing Sheets

NEGATIVE PRESSURE EARPHONE

BACKGROUND OF THE INVENTION

1. Field of the Invention

The invention generally relates to an earphone. More particularly, the invention relates to a negative pressure earphone.

2. Description of the Prior Art

In the conventional earphones, a moving-coil sound-generating unit works according to the principles of electromagnetism and Fleming's left-hand rule. As electricity is fed to the sound generating unit, a diaphragm starts to vibrate. However, as the earphone is attached to an ear, a rapid air flow is generated and causes the diaphragm to deform and generate the unpleasant noises.

Please refer to FIG. 5, which illustrates the conventional earphone. The earphone comprises a main body 1, a cover portion 2, a silicone gel earplug 3, a filtering net 4 and a moving coil sound unit 5. The silicone gel earplug 3 is fitted to the protruding end 111 of the main body 1. The filtering net 4 is provided on the opening of the protruding end and the moving coil sound unit 5 is disposed inside the main body 1. The cover portion 2 is fitted to the other end of the main body 1. One or more holes or openings 10 and 11 are provided in the main body 1 and the cover portion 2. The moving coil sound unit 5 is disposed inside the main body 1. Generally speaking, in the prior art, the moving coil sound unit 5 may have better performance of low-pitched sounds at the cost of the performance of medium-pitched and high-pitched sounds; similarly, the moving coil sound unit 5 may have better performance of high-pitched sounds at the cost of the performance of low-pitched sounds. Moreover, with the presence of these openings 10 and 11, to achieve the optimal sound performance is relatively difficult.

SUMMARY OF THE INVENTION

A negative pressure earphone is disclosed. The negative pressure earphone of the present invention comprises a main body, a cover portion, a silicone gel earplug, a filtering net and a moving coil sound unit. The silicone gel earplug is fitted to the protruding end of the main body. The filtering net is provided on the opening of the protruding end and the moving coil sound unit is disposed inside the main body. The cover portion is fitted to the other end of the main body. A sealing framework portion is disposed inside the main body and the moving coil sound unit is fitted to the sealing framework portion. A negative pressure portion is disposed on the sealing framework portion. The moving coil sound unit and the negative pressure portion are fitted to the sealing framework portion. The negative pressure earphone of the present invention is structurally simple and water resistant and does not have to have an opening in the cover portion and main body. An object of the present invention is to provide a negative pressure earphone in which the incoming air flow may be diverted to avoid the deformation of the diaphragm caused by the rapid air flow as the earphone is inserted into an ear.

One or more negative pressure portions may be disposed on the sealing framework portion. These negative pressure portions may be disposed on the sealing framework portion horizontally or in a tilted manner according to the actual structural need.

These negative pressure portions may have a design according to the shape and structure of the earphone. Therefore, the negative pressure portion may be made of several layers or films that are made of different materials, which include metal, macromolecular chemical and organic material. The negative pressure portion includes a planar base portion, which is made of a layer or film of metal, macromolecular chemical and organic material.

The base portion may be sandwiched between a lower portion and an upper portion, which are made of a composite material.

The composite material may be metal, macromolecular chemical and organic material.

A connective portion may be provided on either side of the planar base portion.

In addition, an end piece may be connected to the end of either connective portion so that the negative pressure portion may be fitted to the sealing framework portion through the engagement between either end piece and the corresponding hole provided in the sealing framework portion.

With the presence of the negative pressure portion, the deformation of the diaphragm caused by the rapid air flow as the earphone is inserted into an ear may be avoided and better sound effect (especially the low-pitched sounds) may be achieved. Therefore, in the negative pressure earphone of the present invention, the openings in the main body and the cover portion in the prior art are not needed. Moreover, the concept of the present invention may be used in the underwater water resistant earphones, which do not have such negative pressure portion in the prior art.

DETAILED DESCRIPTION OF THE PREFERRED EMBODIMENT

Figure 1:
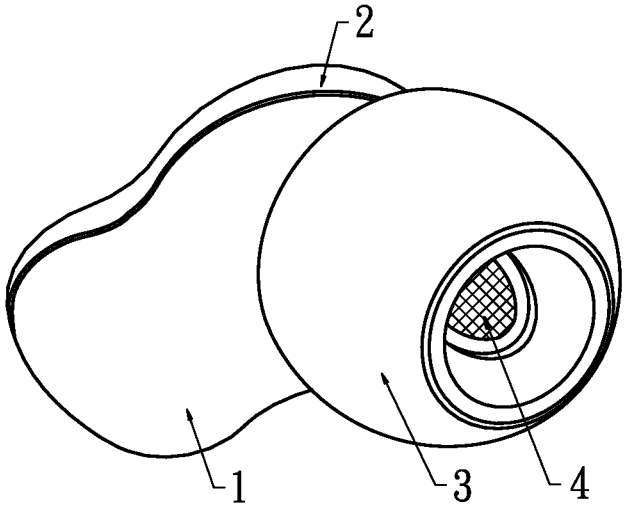
FIG. 1 is a perspective view of the negative pressure earphone of the present invention.
Figure 2:
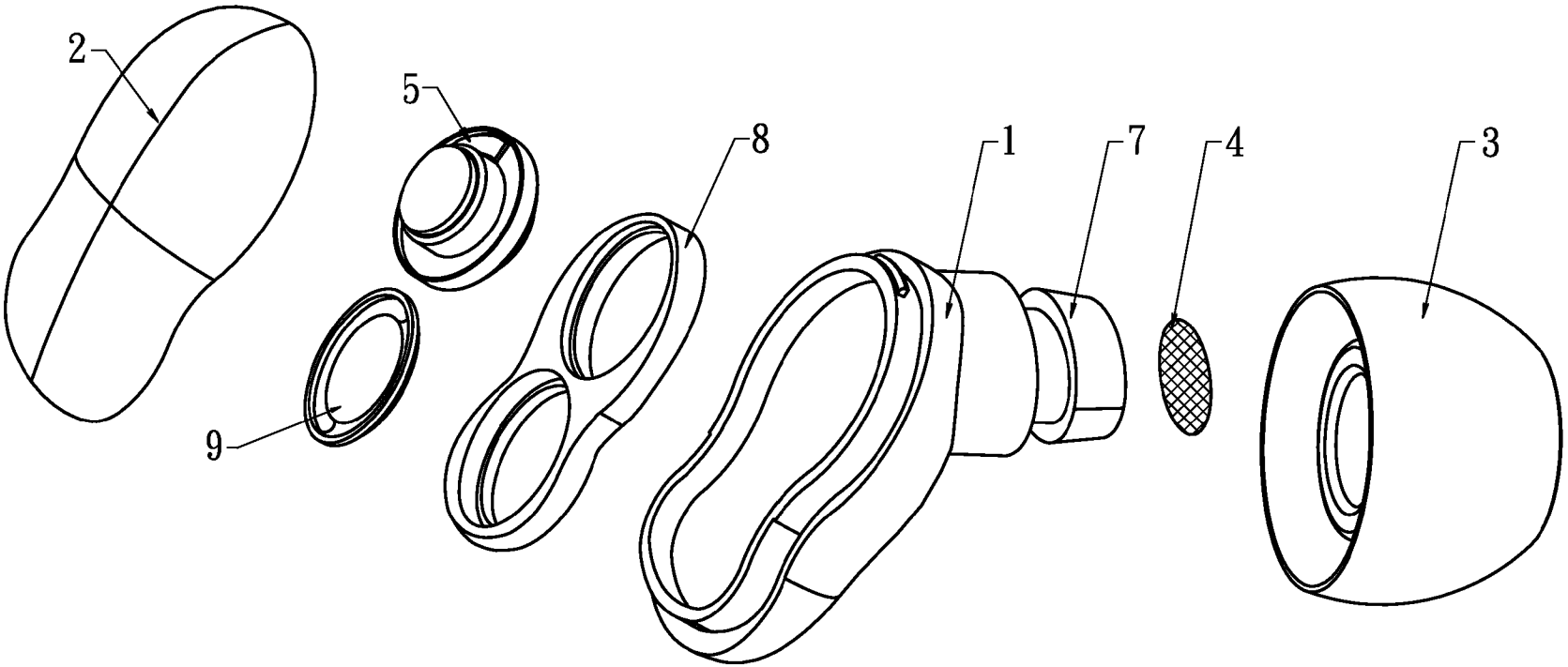
FIG. 2 is an exploded view of the negative pressure earphone of the present invention.
Figure 3:
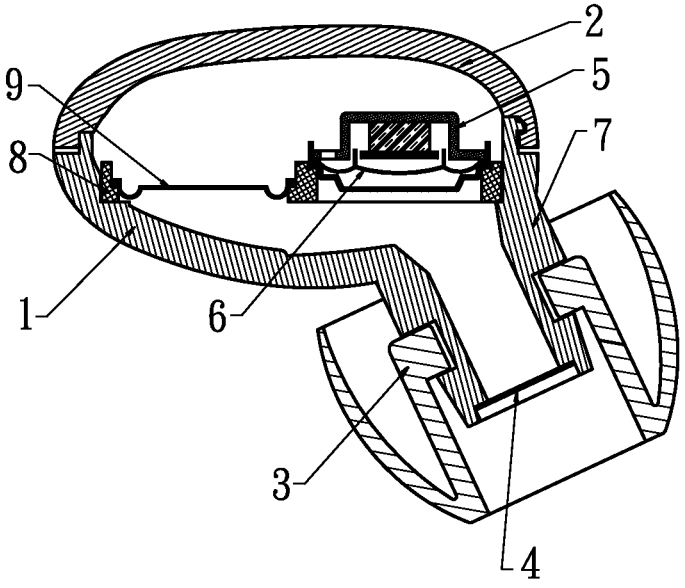
FIG. 3 is a sectional view of the negative pressure earphone of the present invention.

The features and advantages of the present invention will be fully understood and appreciated from the following detailed description of the accompanying drawings. The negative pressure earphone of the present invention is illustrated in FIGS. 1, 2 and 3. The negative pressure earphone of the present invention comprises a main body 1, a cover portion 2, a silicone gel earplug 3, a filtering net 4 and a moving coil sound unit 5. A diaphragm 6 is provided on the moving coil sound unit 5 and the silicone gel earplug 3 is fitted to the protruding end of the main body 1. The filtering net 4 is provided on the opening of the protruding end and the moving coil sound unit 5 is disposed inside the main body 1. The cover portion 2 is fitted to the other end of the main body 1. A sealing framework portion 8 is disposed inside the main body 1 and the moving coil sound unit 5 is fitted to the sealing framework portion 8. A negative pressure portion 9 is disposed on the sealing framework portion 8. The moving coil sound unit 5 and the negative pressure portion 9 are horizontally fitted to the sealing framework portion 8. The sealing framework portion 8 has two openings to hold the moving coil sound unit 5 and the negative pressure portion 9. In addition, a plurality of such negative pressure portions 9 may be disposed on the sealing framework portion 8 horizontally or in a tilted manner according to the actual structural need.

Figure 4:
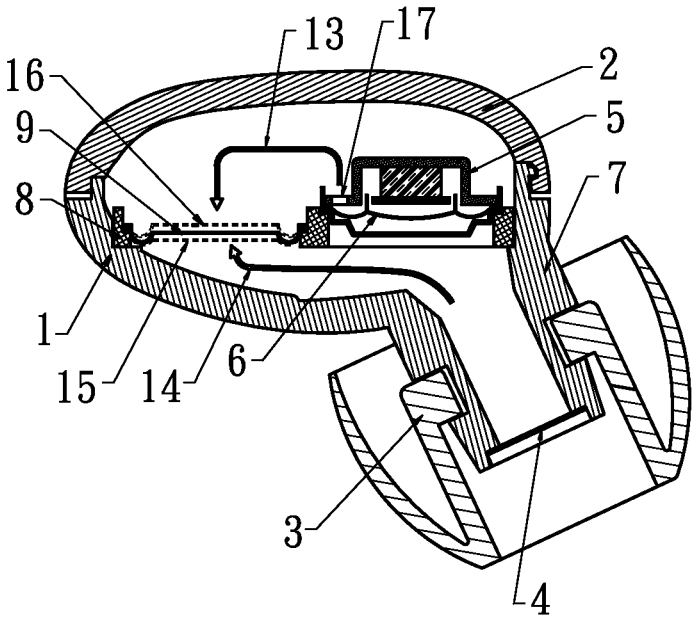
FIG. 4 is a sectional view of the negative pressure earphone of the present invention, showing the direction of the incoming flow.
Figure 5:
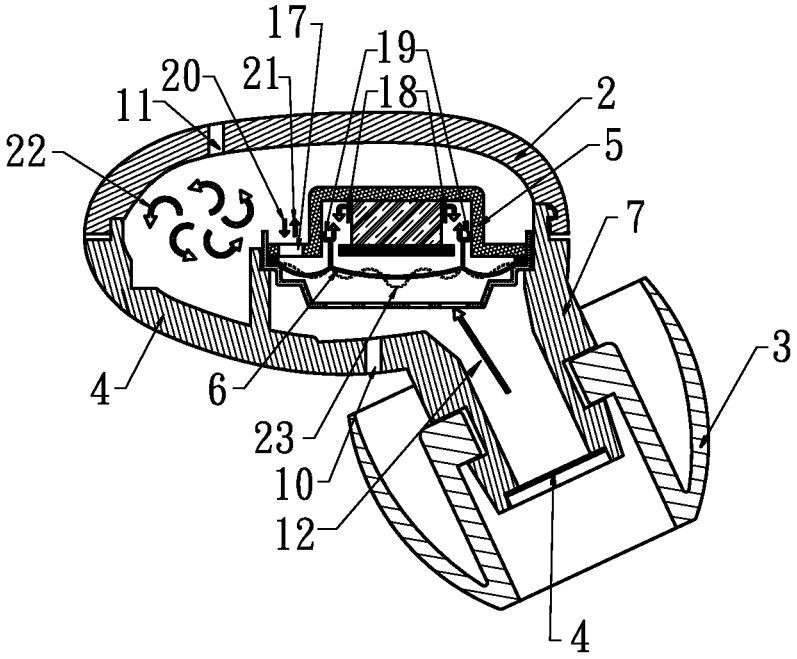
PRIOR ART FIG. 5
FIG. 5 is a sectional view of the earphone of the prior art, showing the direction of the incoming flow.

As illustrated in FIGS. 4 and 5, thanks to the negative pressure portion 9, the incoming air flow 12 illustrated in FIG. 5 is diverted into the air flow 14 illustrated in FIG. 4. When the earphone is inserted into an ear, the air flow 14 exerts pressure on the negative pressure portion 9 and exerts little or no pressure on the diaphragm 6; therefore, the diaphragm 6 is not deformed 23 as illustrated in FIG. 5 and no noises are generated. Also, the opening 10 is not needed. When the earphone is in operation, the air flow 13 generated by the vibrations of the diaphragm 6 exerts pressure on the negative pressure portion 9 to generate the counter flows 15 and 16. Therefore, better low-pitched sound effect may be achieved without the openings provided in the earphone.

Please see FIG. 5, which illustrates the conventional earphone. As the earphone is inserted into an ear, a rapid air flow 12 exerts pressure on the diaphragm 6 to generate the air flows 18, 19 and 21 as well as circular air flows 22. These flows 18, 19, 21 and 22 in turn generate counter flows 20. These flows 18, 19, 21, 22 and 20 cause the diaphragm 6 to deform 23 and generate the unpleasant noises. To solve this problem, an opening has to be provided in the front portion of the main body 1 so as to let out these flows. Therefore, with the presence of such opening, the earphone of the prior art is not water resistant.

Figure 6:
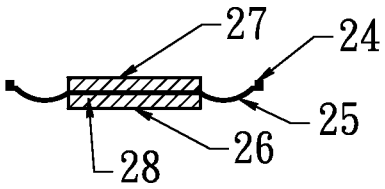
FIG. 6 is an enlarged sectional view of the negative pressure portion of the negative pressure earphone of the present invention.

As illustrated in FIG. 6, the negative pressure portion 9 comprises a planar base portion 28, a lower portion 26, an upper portion 27, two connective portions 25 and two end pieces 24. The base portion 28 is sandwiched between the lower portion 26 and the upper portion 27, which are made of a composite material. The end piece 24 is connected to the end of either connective portion 25. The planar base portion 28, lower portion 26 and upper portion 27 may be made of a thin film or layer of metal, macromolecular chemical or organic material. The two connective portions 25 are optional and they are provided to facilitate the manufacturing. The planar base portion 28, lower portion 26, upper portion 27 and two connective portions 25 may have various types of shapes according to the internal volume and structure of the earphone. Therefore, the negative pressure portion 9 may be made of several layers or portions that are made of different materials, which include metal, macromolecular chemical and organic material. Also, no restrictions are specified on the shape of the negative pressure portion 9 and how its components are combined together.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A negative pressure earphone, comprising:

a main body;

a cover portion, fitted to the rear end of the main body;

a silicone gel earplug, fitted to the protruding end of the main body;

a filtering net, fitted to the protruding end of the main body; and a moving coil sound unit, disposed inside the main body, wherein a sealing framework portion is disposed inside the main body and the moving coil sound unit is fitted to the sealing framework portion, and that a negative pressure portion is disposed on the sealing framework portion and the moving coil sound unit and the negative pressure portion are horizontally fitted to the sealing framework portion, wherein the negative pressure portion comprises one or more negative pressure elements, which are disposed on the sealing framework portion, and wherein the sealing framework portion, negative pressure portion and moving coil sound unit may be fitted or arranged in different manners and at different angles, wherein the negative pressure portion has a planar base portion, which is made of a thin film or layer of metal, macromolecular chemical or organic material, wherein the base portion is sandwiched between a lower portion and an upper portion, which are made of a composite material.

2. The negative pressure earphone as in claim 1, wherein the composite material comprises metal, macromolecular chemical or organic material.

3. The negative pressure earphone as in claim 1, wherein a connective portion is provided on either side of the planar base portion and an opening provided in the middle part of the planer base.

4. The negative pressure earphone as in claim 3, wherein an end piece is connected to the end of either connective portion.

5. The negative pressure earphone as in claim 3, wherein the surfaces of the two connective portions, lower portion and upper portion are smooth or have a certain pattern.

* * * * *